US009759037B2

(12) United States Patent
Shampine et al.

(10) Patent No.: US 9,759,037 B2
(45) Date of Patent: Sep. 12, 2017

(54) METHOD FOR MONITORING CEMENT PLUGS

(75) Inventors: Rod Shampine, Houston, TX (US); Dominique Guillot, Fontenay aux Roses (FR); Douglas Miller, Boston, MA (US); Nicolas Flamant, Montrouge (FR); Pierre Vigneaux, Moisenay (FR)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 894 days.

(21) Appl. No.: 13/129,551

(22) PCT Filed: Nov. 24, 2009

(86) PCT No.: PCT/EP2009/008425

§ 371 (c)(1),
(2), (4) Date: Dec. 15, 2011

(87) PCT Pub. No.: WO2010/060620

PCT Pub. Date: Jun. 3, 2010

(65) Prior Publication Data

US 2012/0073805 A1 Mar. 29, 2012

(30) Foreign Application Priority Data

Nov. 27, 2008 (EP) ..... 08170140

(51) Int. Cl.

| | |
|---|---|
| ***E21B 33/13*** | (2006.01) |
| ***E21B 33/134*** | (2006.01) |
| ***E21B 47/00*** | (2012.01) |
| ***E21B 47/12*** | (2012.01) |

(52) U.S. Cl.
CPC ..... *E21B 33/134* (2013.01); *E21B 47/0005* (2013.01); *E21B 47/12* (2013.01)

(58) Field of Classification Search
CPC ..... E21B 33/13; E21B 47/06; E21B 47/0005
USPC ..... 166/285, 253.1
See application file for complete search history.

(56) References Cited

U.S. PATENT DOCUMENTS

| | | | | |
|---|---|---|---|---|
| 4,607,694 | A | 8/1986 | Sah | |
| 5,467,823 | A * | 11/1995 | Babour et al. | 166/250.01 |
| 6,230,800 | B1 | 5/2001 | Bryant | |
| 6,478,086 | B1 | 11/2002 | Hansen | |
| 7,999,695 | B2 * | 8/2011 | Rodney | E21B 47/12 340/853.3 |
| 2004/0047534 | A1 | 3/2004 | Shah | |

* cited by examiner

*Primary Examiner* — Catherine Loikith
(74) *Attorney, Agent, or Firm* — Michael L. Flynn; Jody Lynn DeStefanis; Robin Nava

(57) ABSTRACT

Cement plug parameters in a wellbore may be monitored by providing a cable through the cement plug before the cement plug sets. The cable comprises one or more sensors that monitor the parameters, and the sensors are operated to transmit measurement data to the surface. The parameters may include temperature, pressure, conductivity, vibration, acceleration and impedance.

26 Claims, 1 Drawing Sheet

METHOD FOR MONITORING CEMENT PLUGS

TECHNICAL FIELD

This invention relates to a method for completing a well. In particular the invention relates to a method for determining the parameters of a cement plug in a wellbore.

BACKGROUND ART

After a well has been drilled there are often situations where the well must be sealed off. This is normally preformed with a cement plug. Other situations that may require sealing off an area of a well include: when a side track is needed during the drilling process; curing lost circulation during drilling; when a zone must be permanently isolated; and when a wellbore is going to be plugged and abandoned.

The cement plug is typically constructed by pumping a small amount of cement slurry down a drill pipe where it later sets solid to form a plug. Drilling operations can resume when the cement plug has set and developed enough strength to fulfil its objective.

In most situations the cement plug must be located some distance off the bottom of the wellbore in either a tubular or open hole section of the well. In order to achieve this, a viscous pill, generally composed of a dense viscous bentonite and sodium silicate mixture, is spotted in the borehole, to support the cement plug. A variation on this method includes the use of an "umbrella" device placed under the drill pipe to support the plug instead of the pill. Alternatively an expanding basket with a membrane over it can be inserted into the wellbore in front of a dart that can be pumped down a drill pipe. The basket expands below the drill pipe on top of which cement is placed.

Problems with these methods are that they result in two heavy fluids stacked on top of a light fluid. One or both fluid interfaces can become unstable leading to inversion. The heavy fluid(s) move down one side of the borehole and the light fluid fluids move up the other side. Considerable mixing and contamination may then occur during the movement of the fluid. The channel formed prevents a pressure seal from being achieved and also significantly reduces the plug's mechanical strength. The mixing of the fluids can also destroy the mechanical strength of the plug. Cement plugs can fail up to third of the time. In lost circulation situations failure rates of cement plugs can be as high as 50%.

Determining whether the plug setting is successful at all, i.e. if the cement is hard enough to side track against and/or if the cement is hard enough to pressure test against, adds significant rig time due to the waiting on cement. Also cement plugs are only placed through drill bits in certain well control situations, and all other situations require tripping out. Thereby requiring installation of the production tube at the bottom of the string, running in and placing the plug. If the cost of tripping out is very high the string may be left in place during the waiting period and then used to tag the plug, in this case a new plug may be placed immediately. Otherwise the driller will trip out and trip back in the drill bit. Once the waiting time is over the driller will try to tag the cement. If the cement is still soft, the driller will wait for longer. As there is great uncertainty about when it is safe to resume drilling operations, to mitigate the risk of resuming drilling operations too soon, it is common practice to wait extra time, typically 24 hours, before resuming drilling.

Therefore it is an object of the invention to provide a method for monitoring a cement plug during in real time to determine the properties of the cement plug.

DISCLOSURE OF THE INVENTION

A first aspect of the invention provides a method of monitoring the parameters of a cement plug in a wellbore comprising;

Placing a cable in the wellbore, wherein said cable comprises a sensor for monitoring parameters of the cement plug;

Locating the extremity of said cable in the proximity of the planned bottom of the cement plug;

Pumping a cement slurry down a wellbore to form the cement plug;

Extending said cable such that its upper end is above the top of the cement plug before the cement plug sets Operating the sensor to measure parameters of the cement plug; and Transmitting information regarding the measurement to the surface.

Preferably the method comprises extending the cable during the pumping of the cement slurry. The cable is preferably extended to surface.

In another embodiment the method comprises locating the sensor in the cement plug.

The cable can also comprise an upper sensor module, wherein the method comprises deploying the cable into the cement plug such that the upper module is located in the proximity of the top of the cement plug.

Alternatively, the method for monitoring the parameters of a cement plug in a wellbore comprises;

Placing a sensor in the wellbore;

Pumping cement slurry down a wellbore to form the cement plug;

Providing a cable through the cement plug before the cement plug sets, wherein the cable comprises a sensor for monitoring parameters of the cement plug;

Attaching the cable to the sensor after the cement is pumped down the wellbore;

Operating the sensor to measure parameters of the cement plug; and

Transmitting information regarding the measurement to the surface.

The method can comprise deploying the cable from the surface. The cable can be deployed from the surface using fluid pumped through a placement conduit. A weight can be provided on the end of the cable to assist the deployment of the cable.

When the cable is stored on the placement conduit the method comprises deploying the cable from the placement conduit used to place the cement plug. The cable can be stored on a tubular element detachable from the end of the placement conduit, wherein the method comprises detaching the tubular element from the placement conduit after the cement is placed and removing the placement conduit from the wellbore, such that the tubular element remains in the cement.

Mechanical means can be provided in the wellbore to assist the deployment of the cable. Mechanical means such as vibrators, propellers, pumps, wheels and/or tracks can be used.

Preferably the cable comprises a fibre optic cable and/or an electrical cable.

The sensors are used to determine the length of the cement plug, evaluate the solidity of the cement plug, to determine the location of the plug, and/or to evaluate the setting of the cement plug. The sensor may be a temperature sensor, pressure sensor, electrical conductivity sensor, vibration sensor, accelerometer, impedance sensor, or other sensor, and/or is capable of making distributed vibration measurements.

The method can further comprise locating a signaling apparatus at the top of the cement plug; and transmitting information regarding the measurement to the surface via the signalling device. The signalling device can comprise an acoustic pressure source.

The cable is provided during pumping of the cement slurry. Alternatively the cable can be provided into the wellbore after pumping of the cement slurry.

MODE(S) FOR CARRYING OUT THE INVENTION

The invention comprises deploying a cable into a cement plug before the cement has set to take measurements for determining properties of the cement plug. The cement slurry may be placed by any known method for forming a cement plug in a wellbore. Cement can be pumped down a cement placement tube to a desired location. The cable is deployed into the cement plug prior to the placement of the cement and prior to the setting of the plug. After the cement has set at least a portion of the cable will be encased in the set cement. The cable comprises sensors to monitor parameters of the cement. The presence of the sensors allows information about the plug to be obtained. As the properties of the cement change with time as it sets, the operator can follow in real time the actual properties of the cement plug. This enables the operator to make timely decisions based on the measurements made, on when further wellbore operations can be resumed, thereby minimising unproductive time.

Information that can be obtained includes information on the location of the plug, the dimensions of the plug, setting state of the plug, identification of channelling occurring in the plug. The information obtained can be used to determine when the cement plug has set sufficiently to enable further wellbore operations to begin i.e. if the cement is hard enough to allow side tracking to begin.

Figure 1:
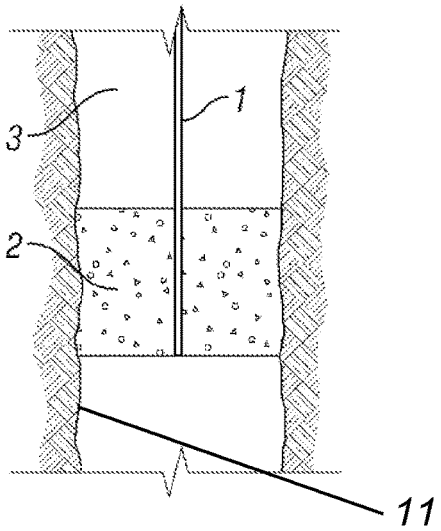
FIG. 1 shows a schematic view of the cable located in the cement plug.

FIG. 1 shows a first embodiment of the invention. The cable 1 is deployed into the cement plug 2 in the wellbore 3 such that a sensor is located at the bottom of the cement plug at the interface of the cement plug and well fluid and a portion of the cable extends along a substantial length of the plug. As seen in FIG. 1, the cement plug 2 extends across the wellbore 3 and seals off wellbore 3 by engaging with a wall 11 of the wellbore 3. The wall 11 of the wellbore 3 may be defined in either a tubular or open hole section of the wellbore 3, as noted hereinabove.

The cable can be deployed from the surface using fluid pumped through the placement conduit. A weight can be attached to the end of the cable to assist the deployment of the cable. The end of the placement conduit can be provided with mechanical means such as vibrators, propellers, pumps, wheels and tracks etc, to assist the deployment of the cable, down the wellbore and into the cement plug.

The cable is connected to a control system at the surface (not shown). The cable is deployed from the surface into the cement slurry before the cement has time to set. The cable extends from the surface through the cement slurry, such that a portion of the cable extends down the length of the cement plug. The cable comprises sensors to make measurements and is positioned in the cement plug so that a sensor is located at the bottom of the cement plug. Once positioned in the cement plug the sensors are then used to make measurements to determine properties of the cement plug. The measurements taken are transmitted up to the surface via the cable. Other telemetry methods can also be used to transmit the information to the surface.

Figure 2:
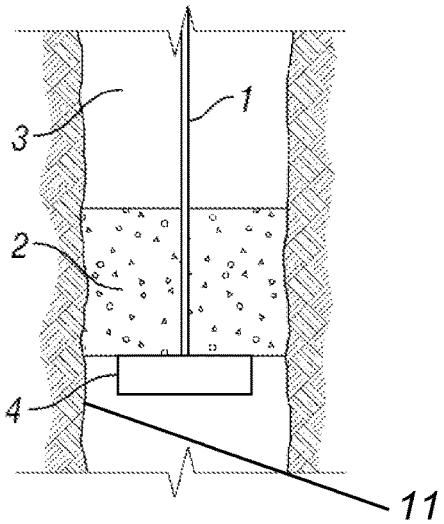
FIG. 2 shows the deployment of the cable through the cement plug.

FIG. 2 shows an alternative embodiment of the invention where the cable 1 is deployed from the surface through the cement plug 2 such that one end of the cable is attached to a lower sensor module 4 located in the wellbore 3 below the cement plug 2 while the other end of the cable 1 is connected to the control system (not shown) on the surface. In addition to being a sensor the lower sensor module 4 may also be present in the wellbore 3 to support the cement plug. In some situations the module may be further located below the supporting pill, in which case the cable will pass through both the cement plug and pill. As seen in FIG. 2, the cement plug 2 extends across the wellbore 3 and seals off wellbore 3 by engaging with a wall 11 of the wellbore 3. The wall 11 of the wellbore 3 may be defined in either a tubular or open hole section of the wellbore 3, as noted hereinabove.

The lower sensor module may be located at or below the bottom of the cement plug. Alternatively the sensor may be located on both sides of the lower boundary of the cement plug so only a part of the lower sensor module is located in the cement plug, with the rest of the sensor in contact with the wellbore fluid. In order to position the lower sensor module at or below the bottom of the cement plug, the sensor module is constructed such that a density difference between the module and the plug and/or pill exists and allows the sensor to be located at the desired position relative to the cement plug. The lower sensor module can comprise a system to produce acoustic signals or pulses that propagate upward through the plug. Such signals can be tracked by the cable and will allow the length of the cement to be measured, and the location of interfaces, the quality of the cement/wellbore interfaces, and the setting of the cement, (by preventing the easy passage of such signals), to be determined.

The cable can also comprise an upper sensor module to be located in the upper region of the cement plug. The upper sensor is preferably lighter than the cement but heavier than the mud, such that when the cable is deployed the module is positioned to sit at the interface of the cement plug and wellbore fluid.

Figure 3:
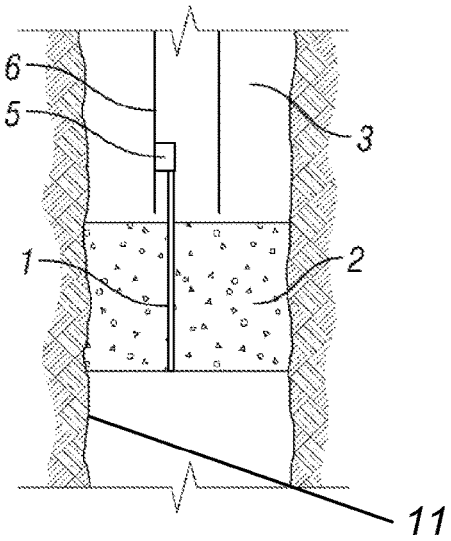
FIG. 3 shows deployment of the cable from the placement tube.

As shown in FIG. 3, in an alternative embodiment of the invention a storage system 5 comprising the cable 1 is attached to the lower end of the placement conduit 6. Once the cement has been placed in the desired location the placement conduit 6 is raised sufficiently to be clear of the top surface of the cement plug 2 and the cable 1 is deployed from the system 5 into the cement plug 2. Measurements are taken using the sensors of the cable 1. A communication wire (not shown) can connect the cable 1 to the surface and transmit information regarding the measurements taken of the cement plug, to the surface. The storage system may be conveyed to surface by removing the placement conduit, leaving the cable deployed along the length of the well. Alternatively, the storage system may be returned to surface by pumping fluid or by running wireline or slickline down the centre of the placement conduit to retrieve the system. As seen in FIG. 3, the cement plug 2 extends across the wellbore 3 and seals off wellbore 3 by engaging with a wall 11 of the wellbore 3. The wall 11 of the wellbore 3 may be defined in either a tubular or open hole section of the wellbore 3, as noted hereinabove.

In a further embodiment a detachable tubular element is located on the end of the placement conduit. The tubular element is detached after the cement is placed and is left behind in the cement. The tubular element comprises the storage system for the cable such that the cable may be paid out as needed.

Figure 4:
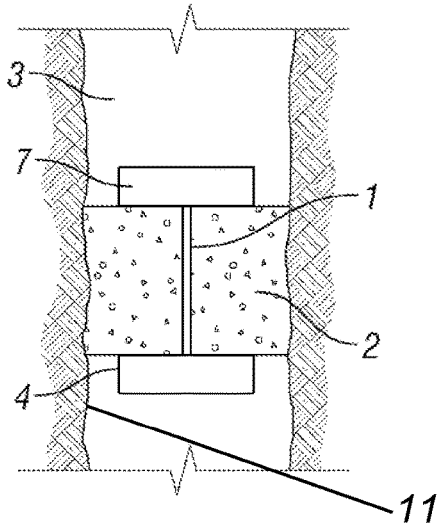
FIG. 4 shows an embodiment of the deployment of the cable through the cement plug.

With reference to FIG. 4 the system can also be provided with an upper signalling module 7. The upper signalling module conveys information to the surface. The signalling module can comprise an acoustic pressure generating mechanism or alternatively the module may comprise a device that can change its acoustic properties sufficiently that such changes can be detected from surface when the device is interrogated by an acoustic wave from surface. The upper signalling module is particular suitable when the cable does not extend to the surface. As seen in FIG. 4, the cement plug 2 extends across the wellbore 3 and seals off wellbore 3 by engaging with the walls 11 of the wellbore 3. The walls 11 of the wellbore 3 may be defined in either a tubular or open hole section of the well, as noted hereinabove.

Preferably the cable is a fibre optic cable, in particular a cable capable of making distributed vibration measurements. However the cable may be formed from a plurality of cables and may be formed from both electrical and fibre optic cables. The cable can comprise all or part of the sensing system, for example an optical distributed temperature sensor. Other wave guide members or sensing strings may also be incorporated into the cable. As well as acting as a sensing cable the cable also acts as a communication wire, allowing information to be transmitted to and from the surface.

In one embodiment the cable comprises both fibre optic and electrical cables, with the portion of the cable passing through the cement plug comprising the electrical cable having an attachment mechanism to connect to the optical fiber which leads to the surface. The electrical cable can be used as a sensor to detect the length of the cement plug and/or to evaluate the solidity of the plug. Measurements based on capacitance, resistance, conductivity, and stress area can be used to determine this information. The electrical cable can comprise electrodes for resistivity measurements at one or more locations in the plug, to help determine the setting length, location and/or to measure the solidity of the plug. Electromagnetic coils may also be located on the electrical cable, to also enable measurements such as resistivity measurements to help determine the setting length, location and solidity of the plug.

The cable can comprise a one or more temperature sensing element such as distributed temperature sensing element. Guided wave radar may also be used along the cable to detect interfaces and/or the solidity of the cement.

Where there are electronics in the cables these may be activated any one of a number of methods; such as signals from down the cable, switching means before they are run into the hole, detecting the launching of the cable from a setting tool, pressure codes, dissolved elements etc. The sensors of the upper and lower sensor modules can also be activated by signals received down the cable to which the sensor modules are attached to. The signals may originate from the surface, or through the detection of actions occurring in the wellbore.

Various changes within the scope of the invention can also be made.

The invention claimed is:

1. A method for monitoring parameters of a single cement plug in a wellbore comprising:

deploying a cable in the wellbore, wherein said cable comprises a sensor for monitoring parameters of a single cement plug, the wellbore defined by an interior wall of a tubular or an open hole section;

pumping cement slurry down a wellbore subsequent to deploying the cable to form the single cement plug, the single cement plug engaging with and extending across the interior wall of the wellbore, thereby sealing off the wellbore;

locating an extremity of said cable through the single cement plug at a location below the bottom of the single cement plug, thereby placing the sensor in direct contact with the single cement plug;

extending said cable such that its upper end is above the top of the single cement plug before the single cement plug sets;

operating the sensor to measure parameters of the single cement plug; and transmitting information regarding the parameters to the surface.

2. The method according to claim 1 wherein extending the cable comprises extending the cable while pumping the slurry.

3. The method according to claim 1 wherein extending the cable comprises extending the cable to the surface.

4. The method according to claim 1 wherein the cable further comprises an upper sensor module, the method comprising deploying the cable into the cement plug such that the upper sensor module is located at the top of the cement plug.

5. The method according to claim 1 comprising deploying the cable from the surface using fluid pumped through a placement conduit.

6. The method according to claim 1 wherein the cable is stored on a placement conduit and the method comprises deploying the cable from the placement conduit.

7. The method according to claim 6 wherein the cable is stored on a section of tubular element detachable from the end of the placement conduit, the method comprising detaching the tubular element from the placement conduit after the cement is placed and removing the placement conduit from the wellbore, such that the tubular element remains in the cement.

8. The method according to claim 1 wherein the cable comprises a fibre optic cable or an electrical cable or both.

9. The method according to claim 1 wherein the operating the sensor comprises operating the sensor to at least determine the length of the cement plug.

10. The method according to claim 1 wherein the sensor is a temperature sensor, a pressure sensor, a conductivity sensor, a vibration sensor, an accelerometer, or an impedance sensor.

11. The method according to claim 1 further comprising locating a signalling apparatus at the top of the cement plug; and transmitting information from the sensors to the surface via the signalling apparatus.

12. The method of claim 1, wherein the sensor is suitable for making distributed vibration measurements.

13. The method of claim 1, wherein the sensor is used to evaluate the solidity of the cement plug.

14. The method of claim 1, wherein the sensor is used to determine the location of the plug.

15. The method of claim 1, wherein the sensor is used to evaluate the setting of the cement plug.

16. The method according to claim 1, wherein transmitting information regarding the parameters to the surface comprises transmitting in real time.

17. The method according to claim 16, further comprising determining, based on the information transmitted in real time, when the mechanical strength of the cement plug is sufficient such that a wellbore operation can be performed.

18. A method for monitoring parameters of a single cement plug in a wellbore comprising:

pumping cement slurry down a wellbore, the wellbore defined by an interior wall of a tubular or an open hole section;

forming a single cement plug to seal off the wellbore by engaging the cement slurry with the interior wall of the wellbore, the single cement plug extending across the wellbore;

providing a cable through the interior of the single cement plug before the single cement plug sets, wherein the cable is inside the single cement plug, wherein the cable comprises a sensor for monitoring parameters of the single cement plug;

operating the sensor to measure parameters of the single cement plug; and transmitting information regarding the parameters to the surface.

19. The method according to claim 18 comprising deploying the cable from the surface.

20. The method according to claim 18, wherein transmitting information regarding the parameters to the surface comprises transmitting in real time.

21. The method according to claim 20, further comprising performing a subsequent wellbore operation based on the information transmitted in real time.

22. A method for monitoring a parameter of a single cement plug in a wellbore comprising:

pumping cement slurry down a wellbore, the wellbore defined by an interior wall of a tubular or an open hole section;

forming a single cement plug with the cement slurry, the cement plug extending across and engaging with the interior wall of the wellbore, thereby isolating the wellbore;

providing a cable through the interior of the single cement plug before the cement sets, wherein the cable comprises a sensor for monitoring parameters of the single cement plug;

operating the sensor to measure parameters of the single cement plug as the single cement plug is setting; and transmitting information regarding the measurement to the surface;

wherein said parameter is one or more members of the group consisting of the length of the single cement plug, the solidity of the single cement plug, the location of the single cement plug, and the setting of the single cement plug.

23. The method of claim 22, wherein the sensor used is one or more members of the group consisting of a temperature sensor, a pressure sensor, a conductivity sensor, a vibration sensor, an accelerometer, an impedance sensor, and a sensor that is capable of making distributed vibration measurements.

24. The method of claim 22, wherein the cable comprises a fibre optic cable or an electrical cable or both.

25. The method according to claim 22, wherein transmitting information regarding the measurement to the surface comprises transmitting in real time.

26. The method according to claim 25, further comprising, based on the information transmitted in real time, performing a subsequent drilling operation engaging with the cement plug.

* * * * *